US010900672B2

(12) United States Patent
Minola

(10) Patent No.: US 10,900,672 B2
(45) Date of Patent: Jan. 26, 2021

(54) BLOWER DEVICE FOR DELIVERING AN AMPLIFIED RATE AIR FLOW AND MODULAR COOLING UNIT

(71) Applicant: SAIPEM S.p.A., Milan (IT)

(72) Inventor: Paolo Minola, Milan (IT)

(73) Assignee: SAIPEM S.p.A., Milan (IT)

( * ) Notice: Subject to any disclaimer, the term of this patent is extended or adjusted under 35 U.S.C. 154(b) by 303 days.

(21) Appl. No.: 15/576,202

(22) PCT Filed: Apr. 15, 2016

(86) PCT No.: PCT/IB2016/052154

§ 371 (c)(1),
(2) Date: Nov. 21, 2017

(87) PCT Pub. No.: WO2016/185300

PCT Pub. Date: Nov. 24, 2016

(65) Prior Publication Data

US 2018/0347833 A1 Dec. 6, 2018

(30) Foreign Application Priority Data

May 21, 2015 (IT) ..... 102015000016345

(51) Int. Cl.
*F24F 1/01* (2011.01)
*F24F 1/0007* (2019.01)
(Continued)

(52) U.S. Cl.
CPC ..... *F24F 1/01* (2013.01); *F04F 5/16* (2013.01); *F04F 5/54* (2013.01); *F24F 1/0029* (2013.01);
(Continued)

(58) Field of Classification Search
CPC .. F24F 1/01; F24F 1/00077; F24F 5/16; F04F 5/54; F04F 1/0029; F04F 5/0007; F04F 7/065; F04F 13/26
(Continued)

(56) References Cited

U.S. PATENT DOCUMENTS 2,095,824 A * 10/1937 McMahan ..... F24F 7/06 236/49.3
3,047,208 A * 7/1962 Coanda ..... D02G 1/161 239/DIG. 7
(Continued)

FOREIGN PATENT DOCUMENTS

| | | |
|---|---|---|
| CN | 201771874 U | 3/2011 |
| GB | 2 455 351 A | 6/2009 |
| WO | 2010/124388 A1 | 11/2010 |

OTHER PUBLICATIONS

International Search Report and Written Opinion of the International Searching Authority for corresponding International Patent Application No. PCT/IB2016/052154 dated Jan. 19, 2017, 9 pages.

*Primary Examiner* — Tho V Duong
*Assistant Examiner* — Raheena R Malik
(74) *Attorney, Agent, or Firm* — Merchant & Gould P.C.

(57) ABSTRACT

A blower device includes a Coanda effect fluid flow amplifier having a suction opening, an outlet opening to provide an amplified fluid flow, an inner passage along an amplifier central axis passing through the suction opening and the outlet opening. An inlet conduit inputs pressurized fluid into the inner passage for drawing the ambient fluid from the suction opening to the outlet opening by Coanda effect, achieving amplified flow. A diffuser downstream of the amplifier includes diffuser side walls that delimit a diffuser inner side surface extending about a diffuser central axis arranged along the amplifier central axis and terminates with a first flow inlet open end facing the outlet opening, and an
(Continued)

opposite second flow outlet open end delivers further amplified fluid flow. At least one side opening is upstream of the second flow outlet open end to allow additional ambient fluid to be sucked into the diffuser.

7 Claims, 9 Drawing Sheets

(51) Int. Cl.

| | |
|---|---|
| ***F24F 5/00*** | (2006.01) |
| ***F04F 5/16*** | (2006.01) |
| ***F04F 5/54*** | (2006.01) |
| ***F24F 7/06*** | (2006.01) |
| ***F24F 13/26*** | (2006.01) |
| ***F24F 1/0029*** | (2019.01) |

(52) U.S. Cl.
CPC ..... *F24F 1/00077* (2019.02); *F24F 5/0007* (2013.01); *F24F 7/065* (2013.01); *F24F 13/26* (2013.01)

(58) Field of Classification Search
USPC ..... 165/123
See application file for complete search history.

(56) References Cited

U.S. PATENT DOCUMENTS 3,628,601 A * 12/1971 Snaper ..... F21V 29/505 165/47
3,885,891 A * 5/1975 Throndson ..... F04F 5/16 417/196
4,002,110 A * 1/1977 Teodorescu ..... F04F 5/16 454/344
4,046,492 A * 9/1977 Inglis ..... F04F 5/16 417/197
4,281,592 A * 8/1981 Maxson ..... F24F 13/26 137/889
4,448,111 A * 5/1984 Doherty ..... F24F 1/01 454/256
4,448,354 A * 5/1984 Reznick ..... B64C 29/00 239/265.17
4,859,430 A * 8/1989 Julian ..... B01J 8/44 422/310
5,402,938 A * 4/1995 Sweeney ..... B05B 1/005 239/431
5,795,517 A * 8/1998 Heisler ..... D04H 1/732 264/115
6,053,054 A * 4/2000 Wusterbarth ..... G01F 1/66 73/861.28
6,269,870 B1 * 8/2001 Banzhaf ..... F01N 3/0205 165/158
6,325,605 B1 * 12/2001 Clements ..... C03B 37/16 239/591
7,654,085 B2 * 2/2010 Dumas ..... F02B 33/40 123/585
8,006,961 B1 * 8/2011 Rutstein ..... F04F 5/16 239/DIG. 7
2002/0070010 A1 * 6/2002 Hakkinen ..... F24F 1/0059 165/123
2007/0062679 A1 * 3/2007 Agee ..... F28F 9/02 165/158
2014/0034039 A1 * 2/2014 Qi ..... F24F 1/01 126/299 D
2016/0175795 A1 * 6/2016 Minola ..... B01J 10/002 564/66
2018/0038271 A1 * 2/2018 Evulet ..... F02B 13/04

* cited by examiner

BLOWER DEVICE FOR DELIVERING AN AMPLIFIED RATE AIR FLOW AND MODULAR COOLING UNIT

This application is a National Stage Application of PCT/IB2016/052154, filed 15 Apr. 2016, which claims benefit of Serial No. 102015000016345, filed 21 May 2015 in Italy and which applications are incorporated herein by reference. To the extent appropriate, a claim of priority is made to each of the above disclosed applications.

FIELD OF THE INVENTION

The present invention relates to a blower device adapted to receive an input supply of compressed air and adapted to generate an outgoing air flow having a flow rate which is much higher than the input compressed air flow rate. Furthermore, the present invention relates to a modular fluid cooling unit for industrial system or cooling skid comprising at least one such blower device.

BACKGROUND ART

The need to cool a fluid which continuously runs in conduits is often felt in the industrial processing field. A tube bundle is generally used, i.e. a plurality of tubes parallel to one another, horizontally arranged and gathered in a group, or skid, constrained to a supporting structure, which is generally metallic. Two connecting portions, or headers, are provided at the ends of the tube bundle and appropriately connect the ends of the tubes to one another. A fluid to be cooled is caused to flow along such a tube bundle. A gap is left between the tubes of the tube bundle adapted to be traversed by a cooling fluid, generally ambient air, to subtract heat from the fluid to be cooled which flows in the tubes.

In this regard, according to the prior art, the ambient air cooling flow is obtained by means of one or more ventilating units comprising fans actuated by respective electric motors to generate a fluid flow generally in transversal direction to the tube bundle and generally from the bottom upwards.

The fans may be arranged according to various configurations, for example over the tube bundle to generate a suction flow away from the tube bundle or under the tube bundle to generate a flow pressing downwards towards the tube bundle. Conveying shields are also present to convey the flow.

A plurality of fans is generally used, which fans are distributed along the tube bundle, connected to one another by electric circuitry comprising electric wires lying along the structure, sometimes inside cable trays.

Such known solutions are not free from disadvantages.

Among the disadvantages of such known solutions, the use of fans actuated by electric motors causes high operating noise. Some industrial standards oblige to keep the noise level in the working environment under a predetermined noise threshold. This requires to apply soundproofing screens to the system adapted to attenuate the noise or requires to intervene on the rotating system.

Another disadvantage of the known solutions is in that the rotating fans comprise rotating masses and such rotating masses must be perfectly balanced otherwise they generate rotating forces applied onto the fan shaft, which generate vibrations that are transmitted to the structure. If they are not damped by the structure, such vibrations are dangerous for the mechanical safety of the working environment because they could cause failures and cracks in the system components with the risk of projecting them. In order to contrast these risks, the prior art requires to make very robust and heavy supporting structures and to provide a series of protections of both the mechanical and electrical type, for example a vibration control device with power cutoff if a limit threshold is exceeded.

SUMMARY OF THE INVENTION

It is an object of the present invention to devise and make available a blower device which allows to satisfy the aforesaid needs and to at least partially overcome the above-described drawbacks with reference to the prior art.

In particular, it is an object of the present invention to make available a blower device for industrial system adapted to provide a high rate fluid flow, which is much less noisy and much safer to use with respect to the known blower devices.

It is an object of the invention to provide a high flow rate fluid blower device to avoid the presence of rotating masses entirely.

It is a further object of the present invention to provide a high flow rate blower device which has a simple and cost-effective layout, for example avoiding any electric power supply system for supplying each blower device.

It is another object of the present invention to provide a high flow rate blower device which does not require a robust and heavy supporting structure.

According to a general embodiment, such a blower device comprises a Coanda effect fluid flow amplifier having a suction opening to suck ambient fluid, an outlet opening to provide an amplified flow of fluid, an inner passage which is developed along an amplifier central axis passing through said suction opening and said outlet opening, an inlet conduit to input pressurized fluid into said inner passage for drawing said ambient fluid from said suction opening to said outlet opening by Coanda effect along said inner passage forming said amplified flow along said amplifier central axis; a diffuser device arranged downstream of said fluid flow amplifier, comprising diffuser side walls which define a diffuser inner side surface which extends around a diffuser central axis arranged along said amplifier central axis and terminates with a first flow inlet open end facing said outlet opening, and a second flow outlet open end opposite to said first flow inlet open end, adapted to deliver a further amplified fluid flow, in which said blower device comprises at least one side opening arranged upstream of said second flow outlet open end to allow a further amount of ambient fluid to be sucked into said diffuser device.

The Coanda effect fluid flow amplifier generates a first flow amplifier stage. It receives a pressurized fluid flow, for example compressed air, through an inlet pipe, from a distribution or supply system. The pressurized fluid flow rate and the fluid pressure required for correct operation is rather low in scope of the common industrial air compressed distribution systems. The pressurized fluid is made to pass through a slit in the fluid flow amplifier and then flows along a Coanda profile of the amplifier towards the amplifier outlet pushing the fluid already present near the profile, thus amplifying the outgoing flow with respect to the pressurized fluid flow and increasing the rate of such a flow.

The amplified flow outgoing from the Coanda effect amplifier is thus the sum of the pressurized fluid flow and of the ambient fluid flow which is pushed by the pressurized fluid.

So, the Coanda effect amplifier does not have any fans, and thus not require any rotating mass, and has no electric motor, but only a normal pressurized fluid or compressed air inlet.

A side opening to allow the suction of a further amount of ambient fluid is advantageously provided between said first flow inlet opening and said outlet opening.

Advantageously, the inner side surface is lapped by said amplified fluid flow.

This allows to obtain an extremely advantageous effect. Indeed, by lapping on the inner surface of the diffuser walls, for example in substantially tangential manner, the amplified flow outgoing from the Coanda effect amplifier creates a Coanda effect here too, making the flow adhere to these walls and pushing a further amount of ambient fluid towards the outlet opening of the diffuser, which ambient fluid is sucked from the ambient through the at least one side opening. In other words, the diffuser generates a further amplified flow given by the amplified flow produced by the Coanda amplifier and by the further contribution sucked through the side opening.

Consequently, the rate of the further amplified flow is much higher than the flow rate of the pressurized fluid input into the amplifier and than the amplified flow rate outgoing from the amplifier.

The blower device according to the invention thus produces the effect of being less noisy and much safer than a blower device with electric fans by virtue of the total absence of rotating masses, while concurrently providing a very high fluid flow rate by virtue of the presence of the diffuser device.

Further advantages are in that the absence of rotating masses avoids the generation of vibrations and that consequently no particularly rigid or heavy supporting structure is required for damping such vibrations.

Furthermore, the absence of an electric motor also allows to avoid lying electric power wires along the system, thus allowing a simpler and more cost-effective arrangement of a plurality of blowers in a cooling system.

The absence of electric motors comprises the further advantage of considerably reducing the energy consumption. Indeed, the blower device according to the invention requires only one pressurized fluid input, for example a compressed air input at a rather low pressure value, commonly already present and available in most industrial systems.

BRIEF DESCRIPTION OF THE DRAWINGS

Various embodiments of the invention will now be described through embodiments provided by way of indicative, non-limiting examples, particularly with reference to the accompanying drawings, in which.

DESCRIPTION OF SOME PREFERRED EMBODIMENTS

Figure 1:
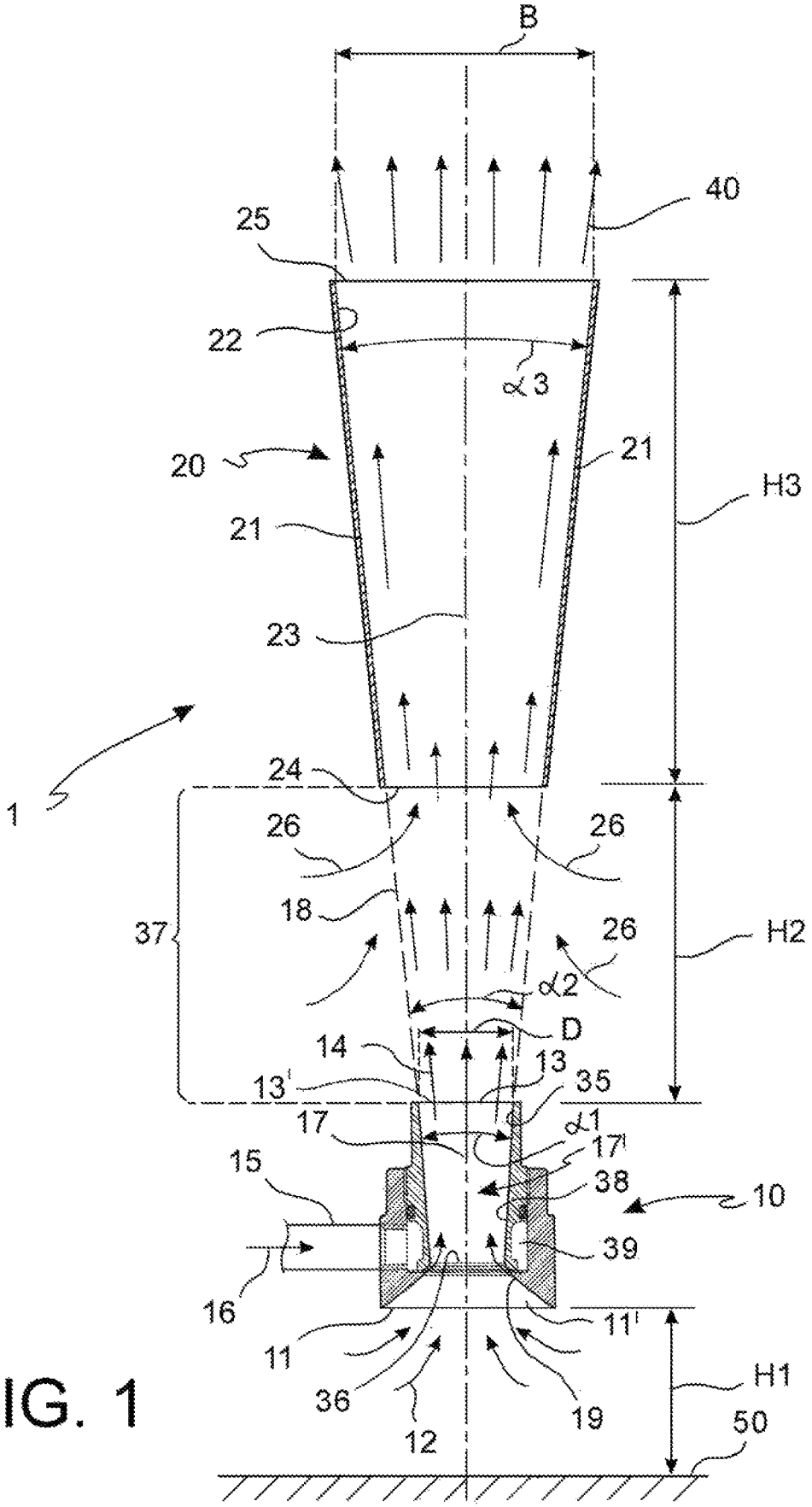
FIG. 1 shows a diagrammatic section view of a blower device according to the invention.

A blower device according to the invention is shown in FIGS. 1 to 11 and indicated by reference numeral 1 as a whole.

The blower device 1 comprises a Coanda effect fluid flow amplifier 10, for example an air amplifier, having a suction opening 11 to suck ambient fluid 12, an outlet opening 13 to provide an amplified fluid flow 14, opposite to said suction opening 11, an inner passage 17' which is developed along an amplifier central axis 17 passing through said suction opening 11 and said outlet opening 13, an inlet conduit 15 to input pressurized fluid 16 into said inner passage for drawing said ambient fluid 12 from said suction opening 11 to said outlet opening 13 by Coanda effect along said inner passage along said amplifier central axis 17'.

In the present description, the flow amplifier will be also be indicated as fluid flow rate amplifier or as fluid amplifier, these being synonyms, meaning that the flow amplifier produces an amplified flow 14 having a flow rate which is higher than the input pressurized fluid flow rate 16. Generally, the ambient fluid may be ambient air.

The Coanda effect is the tendency of a fluid jet to follow the contour of a nearby surface. The phenomenon owes its name to Henri Coandă and is described in patent U.S. Pat. No. 2,052,869.

According to this phenomenon, the fluid by moving along a surface causes friction which tends to slow it down. However, the resistance to movement of the fluid is applied only to the fluid particles immediately in contact with the surface. By effect of molecular interactions, the adjoining fluid particles tend to be attracted by them and as a result rotate around such particles in contact with the surface towards the surface itself. In this manner, the direction of the fluid flow is diverted towards the surface adhering thereto.

According to an embodiment, the inner passage 17' is defined by a side surface 38 which extends around the amplifier central axis 17.

According to an embodiment, the amplifier 10 comprises a toroidal manifold 39 which is coaxial with the amplifier central axis 17, connected to said inlet conduit 15, and fluidically connected to said inner passage 17' by means of an annular slit 19 which is open towards the inner passage 17' through the side surface 38.

According to an embodiment, the side surface 38 is substantially axial-symmetric with respect to the amplifier central axis 17.

The side surface 38 comprises a Coanda profile immediately downstream of the annular slit 19 towards said outlet opening 13.

A Coanda profile is a side surface 38, the section of which taken along a section plane comprising the amplifier central axis 17 is delimited by a profile appropriately designed to optimize the Coanda effect.

The pressurized fluid 16 introduced into the toroidal manifold 39 by means of the inlet conduit 15 operatively flows in the inner passage 17' through the annular slit 19. After having traversed the annular slit 19, the fluid flows in the inner passage 17' adhering to the Coanda profile.

This moving fluid pushes an amount of ambient fluid, which it encounters along the passage 17', drawing it towards the outlet opening 13 and thus amplifying the flow.

According to an embodiment, the outlet opening 13 terminates outwards with an opening edge 13'.

According to an embodiment, the opening edge 13' is arranged on a plane orthogonal to the amplifier central axis 17.

According to an embodiment, the side surface 38 comprises an outlet portion 35 formed by a conical surface coaxial with said amplifier central axis 17, terminating with said opening edge 13' and diverging outwards according to a predetermined angle of conical aperture $\alpha 1$.

According to an embodiment, for example with reference to FIG. 1, the opening edge 13' is substantially circular with predetermined diameter D. The blower device 1 according to the present invention further comprises a diffuser device 20 comprising diffuser side walls 21 which define a diffuser inner side surface 22 which extends around a diffuser central axis 23 arranged along said amplifier central axis 17 and terminates with a first flow inlet open end 24 facing said outlet opening 13, and an opposite second flow outlet open end 25, adapted to deliver a further amplified fluid flow 40.

According to an embodiment, the first flow inlet open end 24 lies on a plane substantially orthogonal to the diffuser central axis 23. This means that according to an embodiment, the first flow inlet open end 24 lies on a plane substantially parallel to the plane on which the edge of the outlet opening 13 lies.

The diffuser device 20 is arranged downstream of the fluid flow amplifier 10, for example aligned therewith, so as to be able to receive therein the amplified flow 14 outgoing from the flow amplifier 10.

For example, with reference to FIGS. 1-3, 9, 10, 11, the blower device further comprises at least one side opening 37 arranged upstream of said second flow outlet open end 25 to allow a further amount of ambient fluid 26 to be sucked into said diffuser device 20.

According to an embodiment, the at least one side opening 37 is arranged downstream of said Coanda effect amplifier device 10.

According to an embodiment, the at least one side opening 37 is interposed between said outlet opening 13 and said second flow outlet open end 25.

According to an embodiment, the at least one side opening 37 is interposed between said outlet opening 13 and said first flow outlet open end 24.

According to an embodiment, the first open end 24 is arranged at a predetermined distance H2 from the outlet opening 13 measured along the amplifier central axis 17, preferably greater than zero.

According to an embodiment, the predetermined distance H2 has a value such to avoid the direct contact between the amplifier outlet opening 13 and the first flow inlet open end 24, thus forming at least one side opening 37 therebetween.

Such at least one side opening 37 is adapted to allow the suction of a further amount of ambient fluid 26 confining with the amplified flow 14 through the at least one side opening 37.

According to an embodiment, the value of a predetermined distance H2 is between 2 and 8 times the predetermined value of diameter D (H2 comprised between 2D and 8D).

Preferably, the value of a predetermined distance H2 is between 4 and 5 times the predetermined value of diameter D (H2 comprised between 4D and 5D).

It has been empirically determined that in such a range of values a high amount of ambient fluid 26 may be sucked through the side opening 37. In such a case, a high ambient fluid flow 26 may be sucked through the side opening 37 thus preventing such a flow from being obstructed by fluid-dynamic factors. In other words, such a predetermined distance value H2 as a function of the diameter of the amplifier outlet opening 13, allows to considerably increase the further amplified flow rate 40.

According to an embodiment, as shown for example in FIG. 1, the inner side surface 22 of the diffuser walls is oriented to be lapped by said amplified fluid flow 14 in at least in part substantially tangential manner.

"In substantially tangential manner" means that the inner side surface 22 is oriented to be lapped in manner substantially parallel to a peripheral portion of the amplified flow 14.

Since the inner side surface 22 is arranged so as to be tangentially lapped at least in part by said amplified fluid flow 14, a second flow amplification effect by Coanda effect is obtained in the contact between the input amplified flow 14 and said inner surface. By virtue of this phenomenon, a further amount of ambient fluid 26 is sucked into the diffuser device 20 together with the amplified flow 14. A further amplified flow 40, which is higher than the amplified flow 14, will be supplied outgoing from the diffuser device 20, through the second outlet open end 25. Also in this case, "amplified flow" and "further amplified flow" mean a "flow with amplified flow rate" and a "flow with further amplified flow rate".

In the present invention, total amplification factor means the ratio between the further amplified fluid flow rate 40 and the pressurized fluid flow rate 16 in input to the fluid flow amplifier 10.

In particularly advantageous cases, it has been found that the total amplification factor of the blower device 1 according to the invention may achieve a value of approximately 30, sometimes even higher.

Such a total amplification factor value is found with the tube bundle inserted. However, the value is conservative, because no back pressure is generated which obstructs the fluid-dynamic amplification in free flow conditions.

According to an embodiment, the amplified flow 14 outgoing from the flow amplifier 10 has the shape of a cone 18 having an angle of aperture of the flow cone $\alpha 2$, coaxial with the amplifier central axis 17 and diverging away from said outlet opening 13.

According to an embodiment, the diffuser inner side surface 22 is at least partially substantially tangent to said cone-shaped amplified flow 14 (e.g. FIG. 1). In this manner, fluid recirculations are minimized in the zones which are not directly hit by the input amplified flow 14.

In other words, the Coanda effect fluid flow amplifier 10 is configured so that said amplified fluid flow 14 is shaped as a cone 18 with axis coinciding with said amplifier central axis 17 and diverging away from said outlet opening 13 according to a predetermined angle of conical aperture $\alpha 2$.

Figure 3:
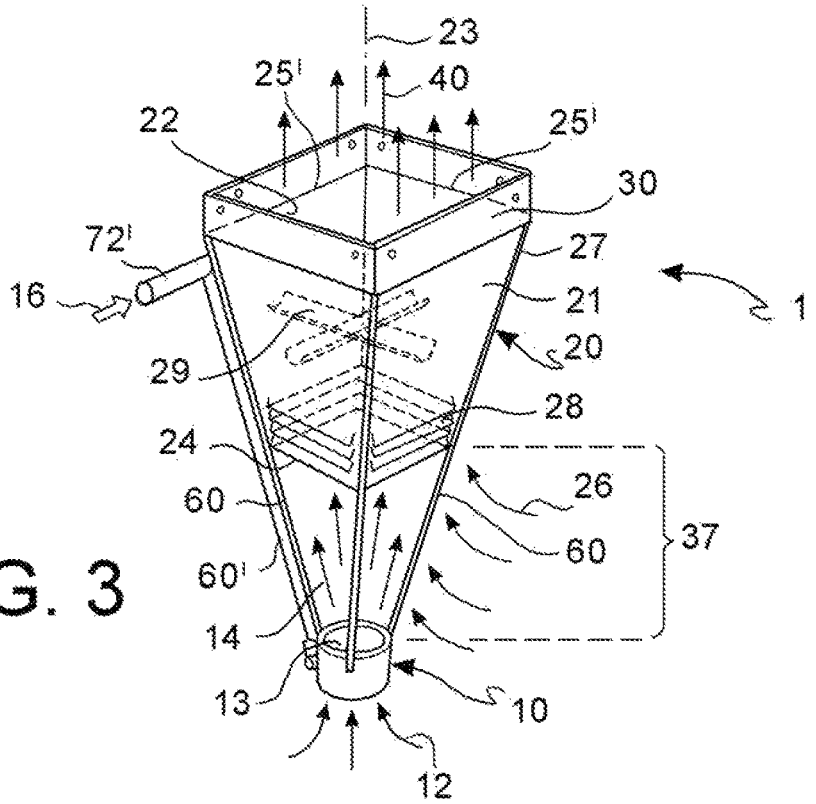
FIG. 3 shows a perspective view of an embodiment of the device in FIG. 1.

According to an embodiment, the side walls 21 are a plurality of trapezium-shaped walls, for example flat walls, connected to each other along the respective oblique sides 27, in which said inner side surface 22 has the shape of a truncated pyramid or truncated cone (e.g. FIG. 3).

According to an embodiment, there are four flat trapezium-shaped side walls 21 connected to one another along the respective oblique sides 27, wherein said inner side surface 22 has the shape of a truncated pyramid, for example such four walls are substantially equal to one another and mutually incident (e.g. FIG. 3).

This configuration allows to arrange a plurality of blower devices arranged side-by-side to cool a tube bundle or a surface to be cooled in uniform manner. In this regard, it is worth looking at FIGS. 5, 6, 7, 8.

According to an embodiment, e.g. with reference to FIG. 1, the distance B between two opposite walls 21, measured at the second flow outlet open end 25 is between the value of the predetermined diameter D and a value equal to the diameter D multiplied 10 times, i.e. B is between D and 10D, preferably the distance B between two opposite walls 21, measured at the second flow outlet open end 25 is between 4 and 6 times D, i.e. B is between 4D and 6D.

According to an embodiment, the inner passage 17' comprises an end conical surface, coaxial with said amplifier central axis 17, having a predetermined angle of aperture of the amplifier cone $\alpha 1$ and diverging away from said outlet opening 13.

A flow amplifier 10 having an outlet portion 35 formed by a conical surface terminating with said outlet opening 13 and diverging outwards according to an angle of aperture of the amplifier cone $\alpha 1$, as described above, and shown for example in FIG. 1, produces an amplified flow defined by a flow cone 18 diverging away from the outlet opening 13 having angle of aperture of the flow cone $\alpha 2$.

In particular, the angle of aperture of the flow cone $\alpha 2$ may be slightly smaller than the angle of aperture of the amplifier cone $\alpha 1$, preferably $\alpha 2$ is generally between 0.7 $\alpha 1$ and 0.8 $\alpha 1$.

Figure 6:
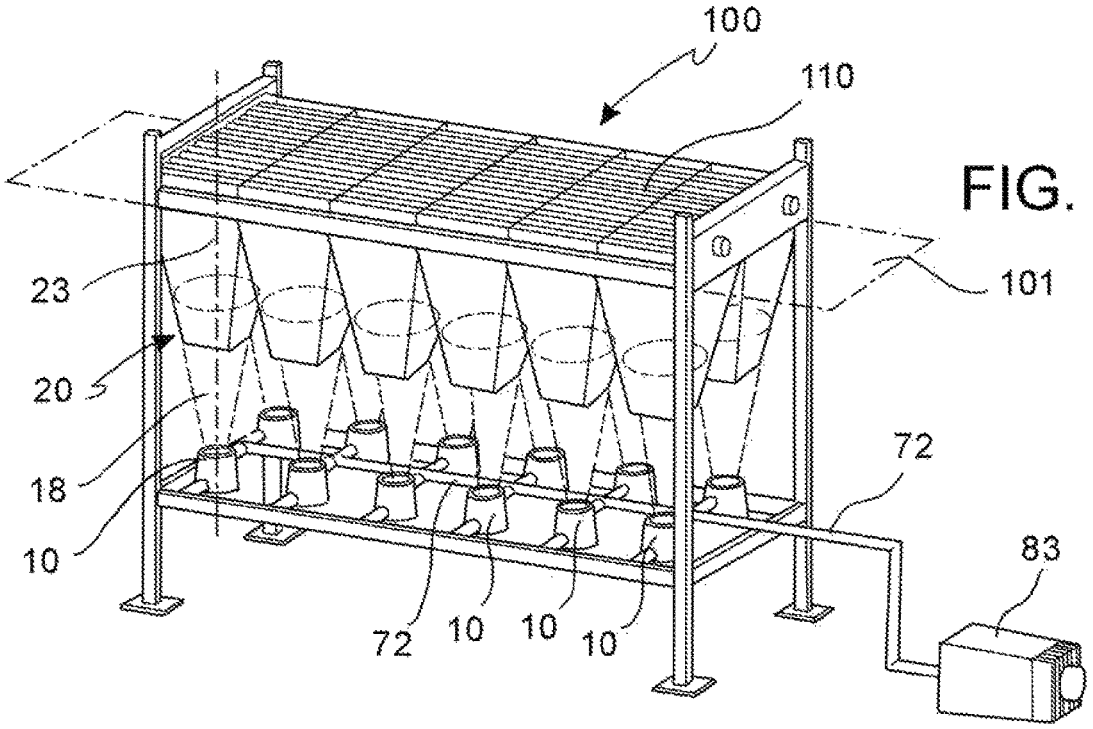
FIG. 6 shows a perspective view of an example of fluid cooling units according to the invention, comprising a plurality of blower devices.
Figure 7:
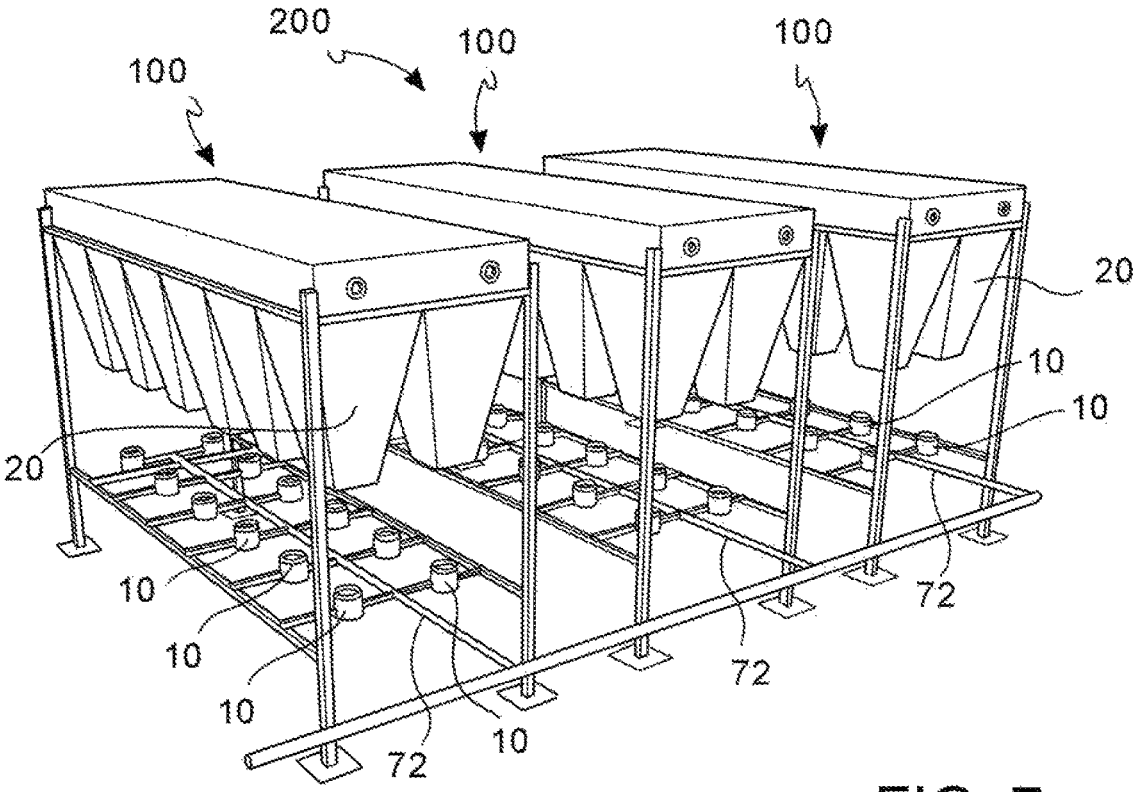
FIG. 7 shows a perspective view of a cooling system according to the invention having a plurality of fluid cooling units 6.
Figure 8:
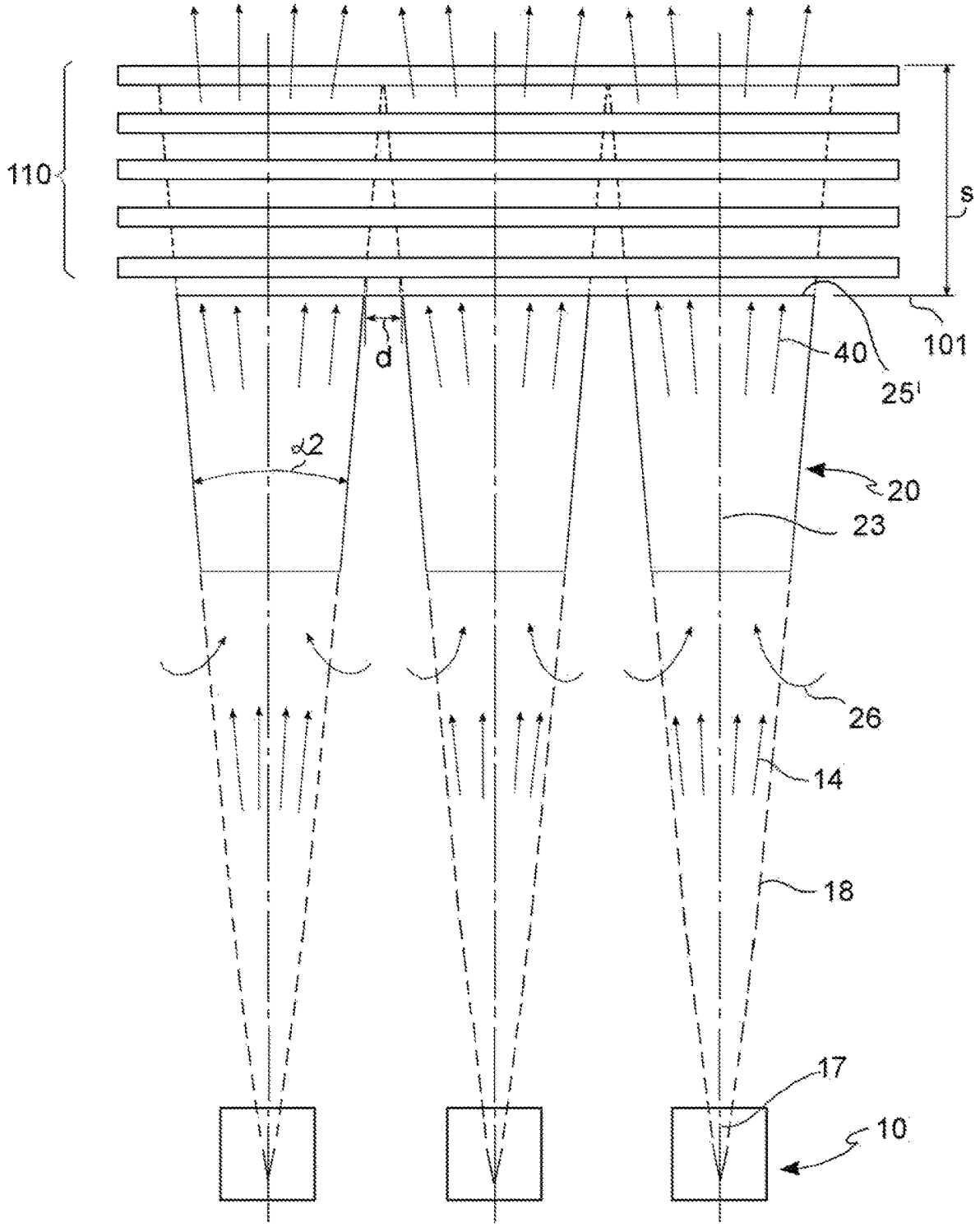
FIG. 8 shows a diagrammatic section view of an example of fluid cooling unit according to the invention comprising a tube bundle in which the diffuser devices are mounted spaced apart from one another.

So, according to an embodiment, as shown for example in FIG. 6, the diffuser inner side surface 22 is at least partially tangent to a conical surface of a flow cone 18 tangent to said amplifier outlet opening 13 at the opening edge 13', coaxial with the amplifier central axis 17.

According to an embodiment, the angle of aperture of the flow cone $\alpha 2$ is not larger than the angle of aperture of the amplifier cone $\alpha 1$.

According to an embodiment, the angle of aperture of the flow cone $\alpha 2$ is between 0.5 $\alpha 1$ and $\alpha 1$, preferably angle of aperture of the flow cone $\alpha 2$ is between 0.7 $\alpha 1$ and 0.8 $\alpha 1$.

Such a configuration allows to obtain a further amplified flow 40 with much higher flow rate despite using a pressurized input fluid 16 having a rather low pressure value with respect to atmospheric pressure, even lower than 8 bar. It has been found that particularly advantageous results can be obtained for normalized fluid pressure values with respect to atmospheric pressure of value between 0.3 and 8 bar, preferably between 1.3 and 7 bar.

According to an embodiment, as shown for example in FIG. 1, the flat walls are inclined with respect to the diffuser central axis by an angle substantially equal to one half of the angle of aperture of the flow cone $\alpha 2$.

According to an embodiment, the diffuser walls 21 are diverging towards the diffuser outlet mutually forming a diffuser angle $\alpha 3$ (FIGS. 1, 9, 10, 11).

Figure 11:
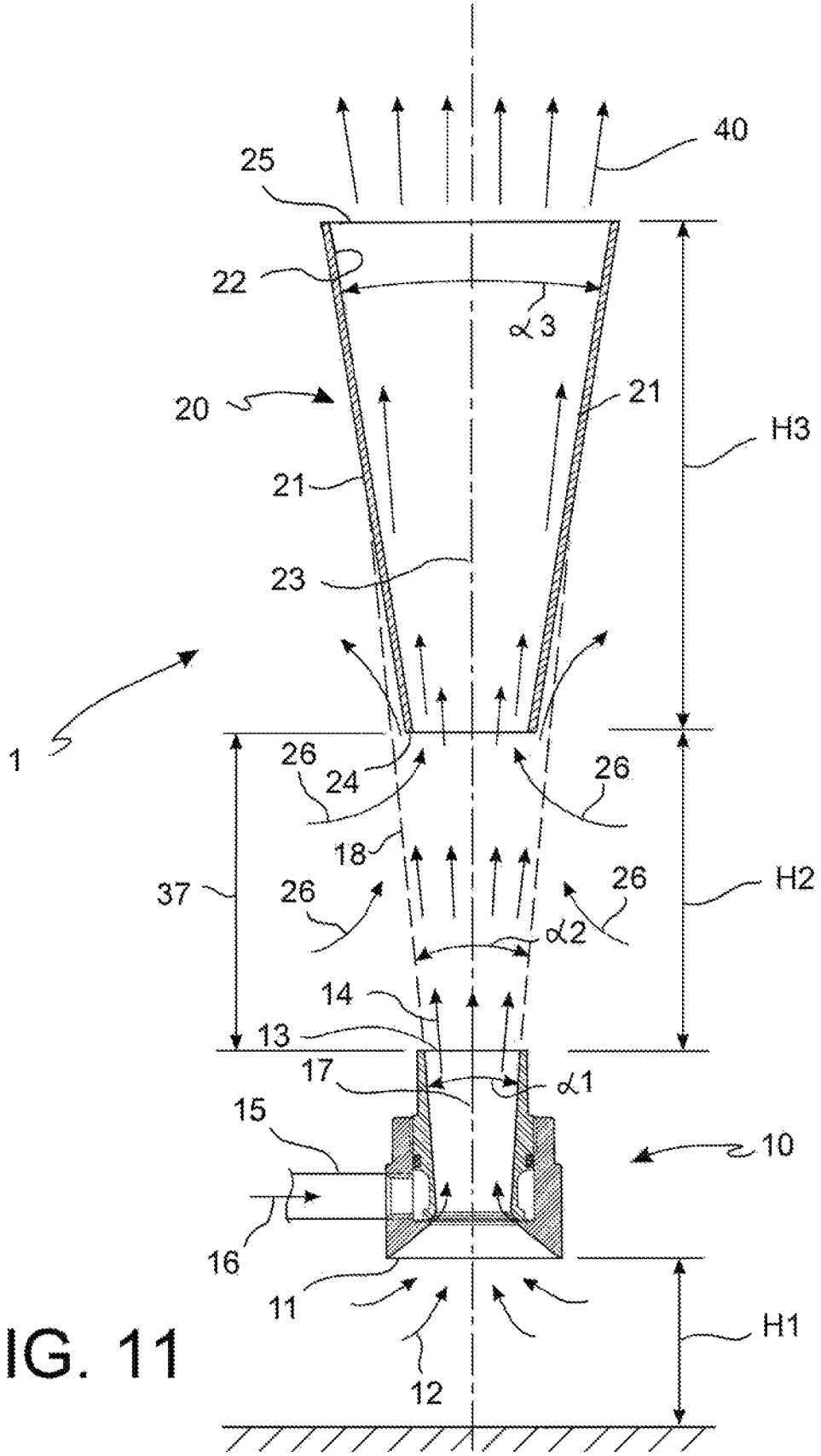
FIG. 11 shows another embodiment of the invention in which the angle of aperture of the diffuser is greater than the angle of aperture of the flow cone outgoing from the Coanda amplifier, and in which the area of the flow cone section entering into the diffuser inlet opening is greater than the section of diffuser inlet opening.

According to an embodiment, e.g. shown in FIG. 11, the diffuser angle $\alpha 3$ is substantially equal to or greater than the angle of aperture of the flow cone $\alpha 2$, for example the diffuser angle $\alpha 3$ is between the value of the aperture of the flow cone $\alpha 2$ and 1.2 $\alpha 2$.

Furthermore, the section area of the amplified flow cone 18 measured in direction orthogonal to the amplifier central axis 17 at the first fluid inlet open end 24 of the diffuser is greater than the area of the section of said first open end 24 measured in orthogonal direction to the amplifier central axis 23.

This solution is particularly advantageous because it allows to obtain the maximum value of the flow amplification factor.

According to an embodiment, as shown for example in FIG. 1, the diffuser inner side surface 22 extends for a predetermined diffuser length H3 measured along said diffuser central axis 23 between said first flow inlet open end 24 and said second flow outlet open end 25, wherein said predetermined distance H2 is smaller than said diffuser length H3. Thereby, a particularly advantageous total amplification factor is obtained because the greater length of the inner surface 22 with respect to the outlet opening 13 and the first flow inlet end 24 allows to suck a greater amount of ambient fluid 26.

According to an embodiment, the diffuser length H3 is greater than or equal to 1.5 m and the predetermined distance H2 is greater than or equal to 1 m.

According to an embodiment, the inner side surface 22 has the shape of a truncated cone, for example with opening substantially equal to said angle of aperture of the flow cone $\alpha 2$. Thereby, the amplified flow 14 completely adheres to the inner surface 22, thus providing a much higher result in terms of total amplification factor.

Figure 2:
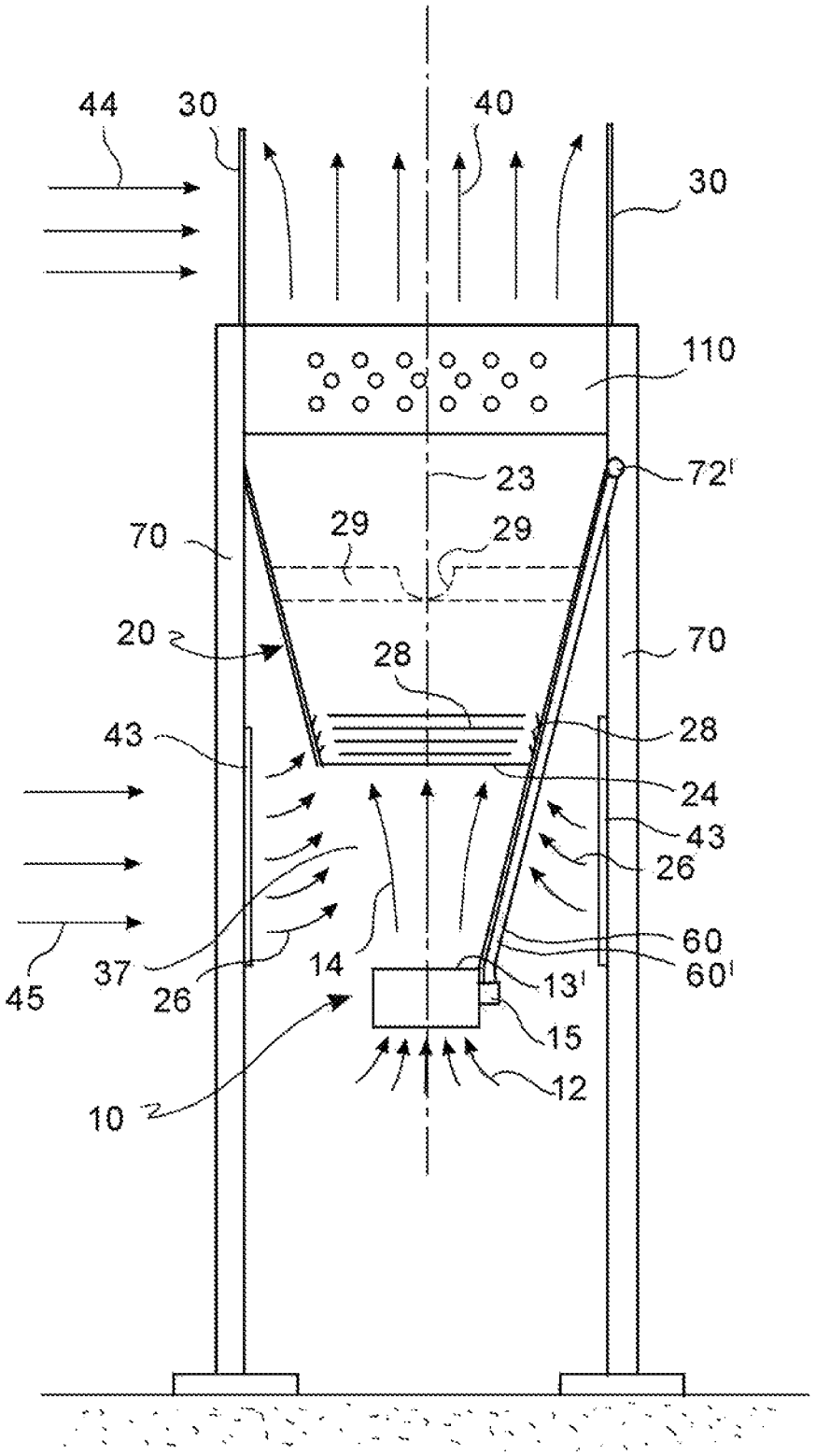
FIG. 2 shows a diagrammatic section view of an embodiment of the device in FIG. 1.

According to an embodiment, for example with reference to FIGS. 2 and 3, the diffuser side walls 21 comprise at least one slit 28 which extends in a substantially transverse direction with respect to said diffuser central axis 23.

Such slits allow to increase the further amount of ambient fluid 26 sucked by the diffuser device 20.

According to an embodiment, such slits 28 are obtained by partially cutting a slot edge and folding around an uncut side according to an angle such to facilitate the passage of the further sucked fluid 26.

According to an embodiment, as shown for example in FIG. 3, the diffuser device 20 comprises at least one deflector member 29, or flow baffle, arranged inside said diffuser device 20 so to be hit by said amplified flow 14 in order to distribute it uniformly.

According to an embodiment, the diffuser device 20 comprises atomizers which lead into the diffuser device 20. Such atomizers increase the cooling action of a tube bundle in given operating conditions.

According to an embodiment, as shown in the figures, the diffuser central axis 23 is operatively arranged in a substantially vertical direction. According to this embodiment, the blower device 1 exploits the flue effect of the diffuser device 20, thus providing a further contribution favorable to the formation of further amplified flow 40, and supplying a greater further amplified flow rate 40.

According to an embodiment, as shown for example in FIG. 1, the fluid flow amplifier 10 is interposed between a flow plane 50, on which said blower device 1 either rests or its fixed, and said diffuser device 20, in which said suction opening 11 faces towards said floor plane 50 and is arranged at a predetermined distance H1 from said floor 50. Such a predetermined distance H1 is calculated so as not to obstruct the sucked ambient fluid flow 12 through the suction opening 11.

According to an embodiment, such a predetermined distance is approximately 1 m. In addition to avoiding obstructing the sucked ambient fluid flow 12, such a distance value also permits easy access to the component parts of the blower device 1.

According to an embodiment, the blower device 1 comprises upper protective side walls 30 arranged around said diffuser central axis 23 downstream of said second flow outlet open end 25, which extend upwards, for example starting from said second flow outlet open end 25. If the diffuser device is arranged with central axis 23 in the vertical direction, such upper protective walls provide a further flue effect which promote the exiting of the further amplified flow 40 from the blower device 1.

According to an embodiment, as shown for example in FIG. 2, the blower device 1 comprises upper side protective walls 30 arranged around said diffuser central axis 23, spaced apart from said second flow outlet open end 25 and aligned therewith. In such a case, a tube bundle may be interposed between said flow outlet opening 25 and said upper side protective walls 30. In such a case, the flue effect facilitates the passage of the further amplified flow 40 through the tube bundle.

According to an embodiment, the upper side protective walls 30 extend parallel to the diffuser central axis 23, as shown for example in FIG. 2.

The upper protective walls 30 also produce an effect of protecting the further amplified flow 40 against an interaction of external side currents 44.

According to an embodiment, as shown for example in FIG. 2, the blower device comprises a connecting structure 60 which connects said flow amplifier 10 and said diffuser device 20 to each other.

According to an embodiment, the connecting structure comprises at least one tubular member 60'.

According to an embodiment, as shown for example in FIG. 2, the tubular member 60' at least partially forms the inlet conduit 15 therein to input pressurized fluid 16 into the flow amplifier device 10.

Figure 4:
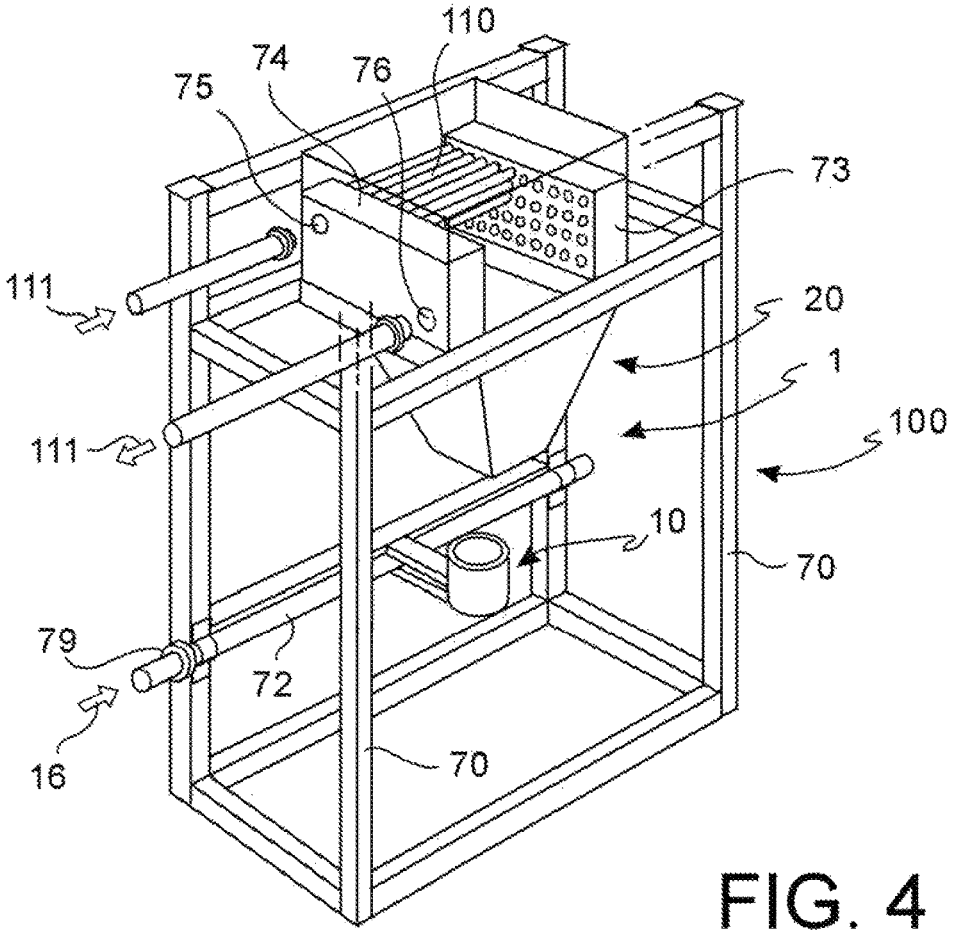
FIG. 4 shows a perspective view of a modular fluid cooling unit according to an aspect of the invention.
Figure 5:
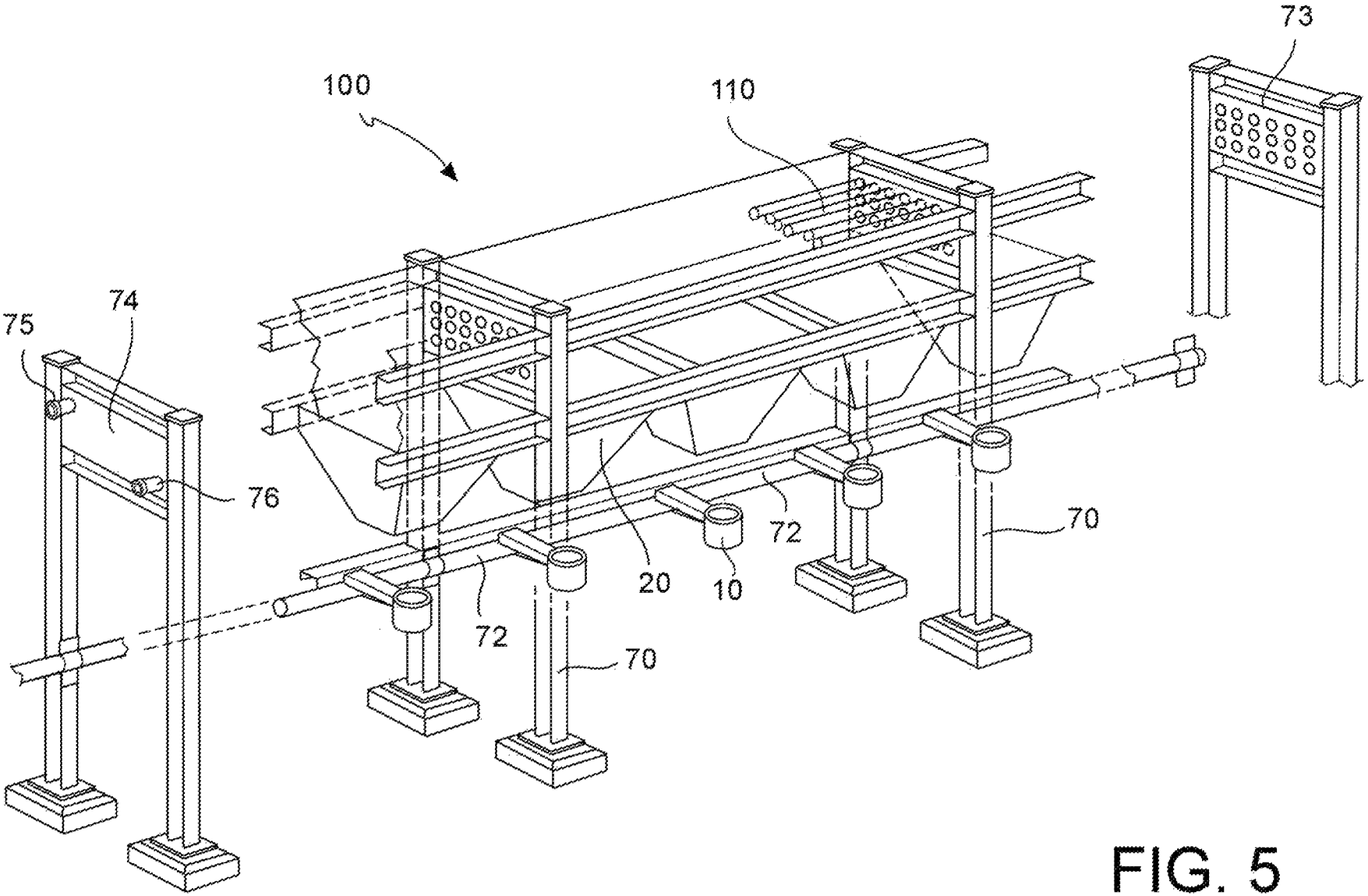
FIG. 5 shows a diagrammatic perspective view of an example of a modular fluid cooling unit according to the invention, having five blower devices in line, a tube bundle and headers, shown disassembled and moved away from the tube bundle for ease of illustration.

According to an embodiment, as shown for example in FIGS. 2 and 4, the blower device comprises a supporting frame 70 adapted to support said blower device 1, e.g. in a predetermined position.

For example, such a frame 70 may comprise tubular members.

According to an embodiment, the blower device 1 comprises further protective walls 43, as shown for example in FIG. 2, arranged laterally and externally to the amplified flow 14 between said amplifier device 10 and said diffuser device 20 to protect the amplified flow 14 from external currents. For example, such further protective walls 43 are fixed to said supporting frame 70.

Figure 9:
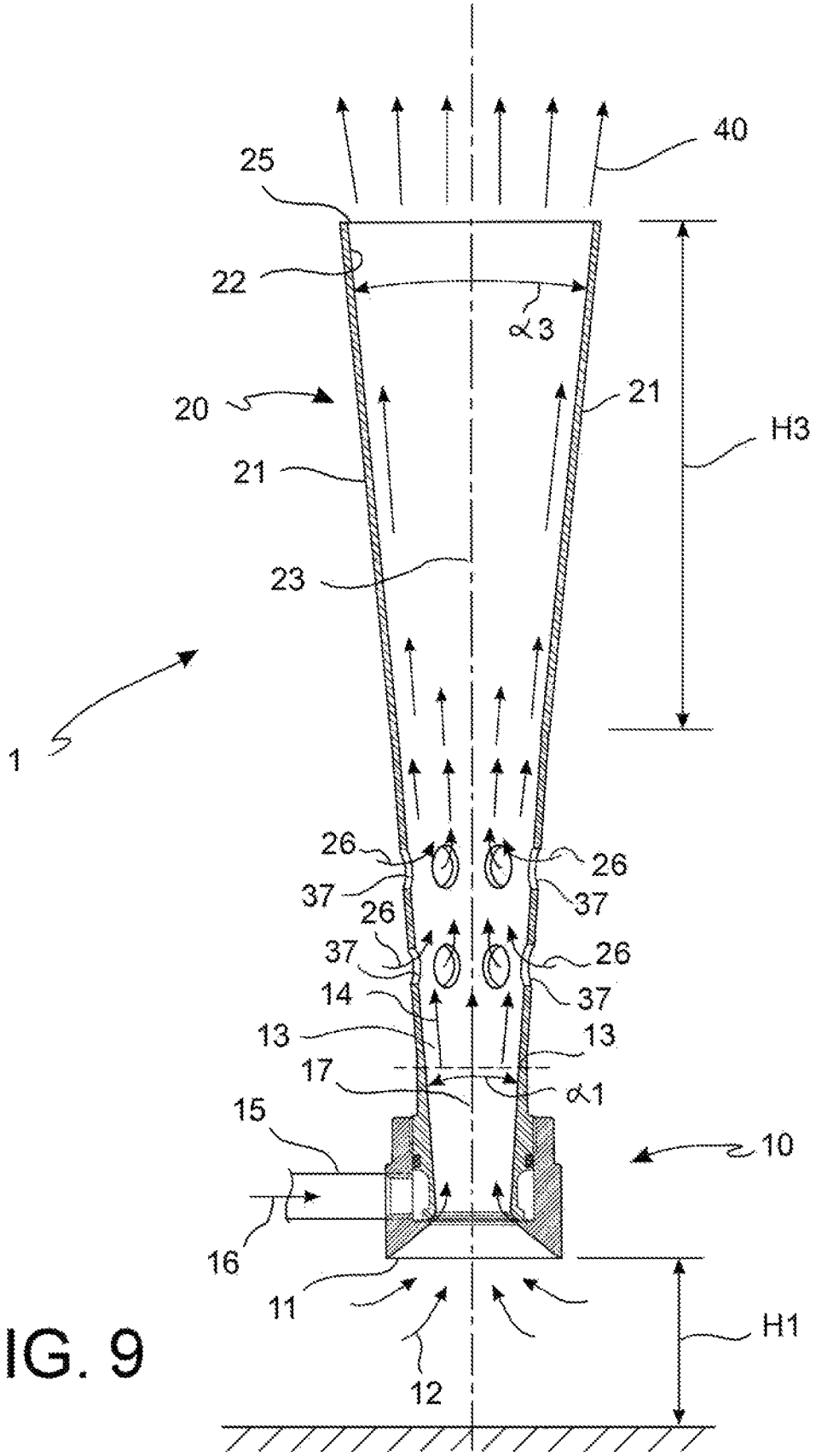
FIG. 9 shows an example of blower device according to the invention in which the diffuser device is made in one piece with the amplifier device as extension of the inner conduit.

According to an embodiment of the invention, as shown for example in FIG. 9, the blower device 1 comprises a Coanda effect fluid flow amplifier 10, a diffuser device 20 arranged downstream of said fluid flow amplifier 10, a suction opening 11 for sucking ambient fluid 12, a second flow outlet open end 25 opposite to the suction opening 11, an inlet opening 15 to input pressurized fluid 16 for drawing by Coanda effect said ambient fluid 12 between said suction opening 11 to said second flow outlet open end 25; at least one side opening 37 arranged upstream of said second flow outlet open end 25, to allow a further amount of ambient fluid 26 to be sucked into said diffuser device 20.

Such a blower allows to obtain a high further amplified flow rate 40 with respect to the input pressurized flow rate 16, permitting to obtain a high amplification ratio.

Such a blower may be made according to any embodiment described above.

According to an embodiment, an example of which is shown in FIG. 9, the diffuser device 20 is made integral or in one piece with the amplifier device 10, for example forming an extension of the inner conduit 17' of the amplifier 10.

According to an embodiment, the first flow inlet opening 24 is directly joined to the outlet opening 13 of the amplifier 10.

For example, the first flow inlet opening end 24 is directly welded to the outlet opening 13 of the amplifier 10, or is connected by means of a threaded coupling.

The at least one side opening 37 may be made, for example, in the diffuser wall 21. For example, such diffuser walls form a conical wall, for example such a conical wall has an angle of conical aperture $\alpha 2$ substantially equal to the angle of aperture of the amplifier cone $\alpha 1$.

Figure 10:
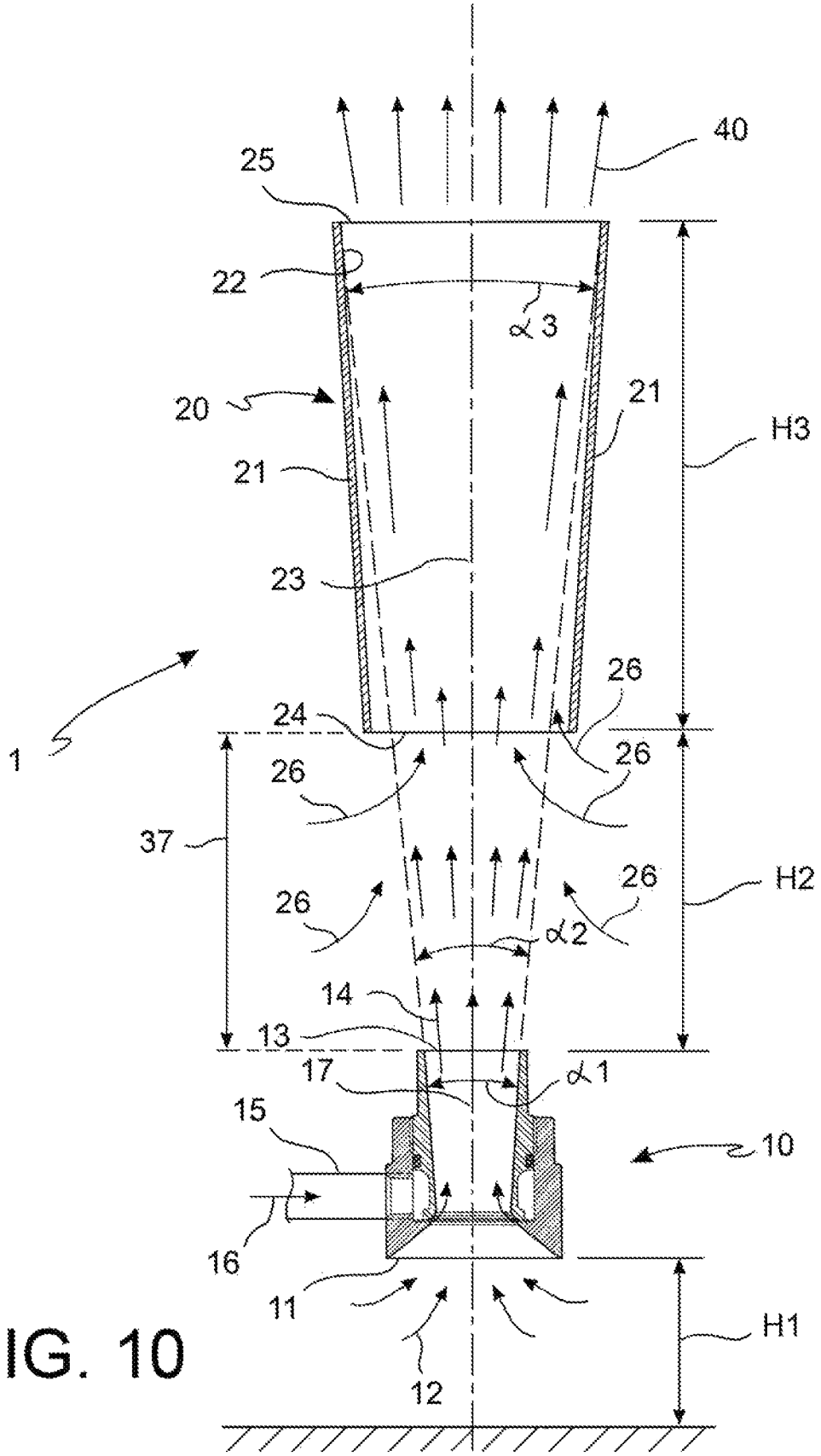
FIG. 10 shows another embodiment of the invention in which the diffuser device has a first flow inlet open end having a diameter larger than the amplified flow cone.

FIG. 10 shows a possible embodiment of the invention, less performing than those described above, in which the first flow inlet open end 24 has a section area measured on a section plane orthogonal to the diffuser central axis 23 at said flow inlet open end 24, of greater value than the section area of the amplified flow section area 14 measured on the same section plane. Thereby, the amplified fluid flow 14 draws a portion of ambient fluid 26 into a gap between the amplified flow cone 14 and the diffuser inner side surface 22. However, the further amplified flow rate 40 according to this embodiment is lower than that which can be obtained if the amplified flow 14 is either tangent at least in part to the inner diffuser surface 22 or parallel to the inner diffuser surface 22.

According to another aspect of the invention, the described objects and advantages are obtained by a method for amplifying a pressurized fluid flow 16 to deliver a further amplified fluid flow 40, comprising the steps of:

- providing a blower device 1 according to any embodiment described above;
- amplifying said pressurized fluid flow 16 by means of the Coanda effect fluid flow amplifier 10, obtaining an amplified flow 14;
- sucking a further amount of ambient fluid 26 into the diffuser device 20 through at least one side opening 37 arranged upstream of the second flow output opening 25 of the diffuser device 20, thus obtaining output from said diffuser device 20 said further amplified fluid flow 40 comprising said amplified flow 14 and said further amount of ambient fluid 26.

According to another aspect of the invention, the aforesaid objects and advantages are achieved by a modular cooling unit 100, or cooling skid, comprising:

- a blower device 1 as described above, in which the second flow outlet open end 25 of the diffuser device 20 lies on a lying plane 101 transverse to the diffuser central axis 23, for example substantially orthogonal to the diffuser central axis 23;

a tube bundle 110 comprising a plurality of tubes adapted to be traversed by a fluid to be cooled 111 (FIG. 4) and adapted to be externally lapped by said further amplified flow 40, said tube bundle 110 being arranged on the opposite side of the lying plane 101 with respect to said diffuser device 20.

According to an embodiment, the modular cooling unit comprises a frame 70 to support said blower device 1 and said tube bundle 110.

According to an embodiment, the modular cooling unit 100 comprises a supply conduit 72 for pressurized fluid fluidically connected to said flow amplifier inlet conduit 15.

According to an embodiment, the supply conduit 72 comprises a connecting portion 79 adapted to be connected to a corresponding supply conduit of an adjacent modular cooling unit.

According to an embodiment, the modular cooling unit 100 comprises headers 73, 74 of said tube bundle 110 comprising portions of mutual fluid connection of said tubes according to a fluid circuit.

According to an embodiment, the headers 73, 74 comprise an inlet passage 75 and an outlet passage 76 for the flow of the fluid to be cooled, for example adapted to be fluidically connected to an header of an adjacent modular cooling unit.

According to an embodiment, the modular cooling unit 100 comprises a plurality of blower devices 1 described above.

According to an embodiment, such blower devices 1 are arranged mutually side-by-side so that the diffuser central axis 23 of each blower device 1 is substantially parallel to the diffuser central axis 23 of the other blower devices 1 of the plurality.

According to an embodiment, said supply conduit 72 for pressurized fluid is fluidically connected to the inlet conduits 15 of the flow amplifiers of all blower devices.

According to an embodiment, the second open end 25 of each diffuser device 20 lies on the same lying plane 101.

According to an embodiment, the lying plane 101 is substantially orthogonal to said diffuser central axis 23 of the blower devices 1 of said plurality, and, for example, said tube bundle 110 is arranged on the opposite side of the lying plane 101 with respect to a plurality of blower devices 1.

According to an embodiment, the second open end 25 of each diffuser device 20 has the shape of a straight side closed polygon 25'.

According to an embodiment, the straight sides 25' of each diffuser 20 are arranged parallel to corresponding straight sides 25' of adjoining diffuser devices 20 and at a predetermined distance d from one another.

According to an embodiment, said predetermined distance d is substantially equal to the product of $2S \times tg(\alpha 2/2)$, where $\alpha 2$ is the aforesaid angle of aperture of the flow cone and S is the thickness of the tube bundle measured in direction parallel to the diffuser central axis 23. Thereby, such a distance d allows to exploit the divergence of the further amplified flow 40 outgoing from the second flow output opening 25.

According to another aspect of the invention, the aforesaid and other objects are satisfied by an industrial fluid cooling system 200 comprising a plurality of modular cooling units 100 as described above.

According to an embodiment, the fluid cooling system 200 comprises a compressor 83 fluidically connected to said supply conduit 72 of each modular cooling unit. Thereby, one single compressor 83 supplies all the amplifier devices 10. This simplifies the remote control and adjusting the partial flow rates.

In addition to the above-described advantages, the present invention implies the following advantages.

The absence of rotating masses allows to avoid dynamic imbalance phenomena.

The absence of electric circuitry allows a simplified amplification in high explosion risk environments.

The absence of fans allows to obtain low noise and thus avoid problems related to compliance with environmental standards.

The presence of a single supply compressor to a series of modular cooling units for the same process flow simplifies the remote control system and the adjustment of the partial fluid flow rates.

The modularity and geometric flexibility of the layout allows easy adaptability in new and existing systems and permits a greater facility of amplification in conditions of limited space and dimensions.

High ease of inspection and maintenance is allowed because the compressor may be arranged in an easy, accessible position and because the amplifiers are arranged at a given height from the floor deck.

Those skilled in the art may make changes and adaptations to the embodiments of the above-described device or can replace members with others which are functionally equivalent to satisfy contingent needs without departing from the scope of the appended claims. All the features described above as belonging to a possible embodiment may be implemented independently from the other embodiments described.

The invention claimed is:

1. A cooling unit, comprising:

a blower device comprising:

a Coanda effect fluid flow amplifier having a suction opening to suck ambient fluid, an outlet opening to provide an amplified flow of fluid, an inner passage along an amplifier central axis passing through said suction opening and said outlet opening, an inlet conduit to input pressurized fluid into said inner passage for drawing said ambient fluid from said suction opening to said outlet opening by Coanda effect along said inner passage forming said amplified flow along said amplifier central axis;

a diffuser device arranged downstream of said fluid flow amplifier, comprising diffuser side walls which define a diffuser inner side surface extended around a diffuser central axis arranged along said amplifier central axis and is terminated with a first flow inlet open end facing said outlet opening, and a second flow outlet open end opposite said first flow inlet open end, adapted to deliver a further amplified fluid flow, wherein said blower device comprises at least one side opening arranged upstream of said second flow outlet open end, to allow a further amount of ambient fluid to be sucked into said diffuser device;

wherein the second flow outlet open end of the diffuser device lies on a lying plane transverse to the diffuser central axis;

a tube bundle comprising a plurality of tubes adapted to be traversed by a fluid to be cooled and adapted to be lapped externally by said further amplified flow, said tube bundle being arranged on the opposite side of the lying plane with respect to said diffuser device;

a frame to support said blower device and said tube bundle.

2. The cooling unit according to claim 1, comprising:

headers of said tube bundle comprising portions of mutual connection of said tubes, said headers comprising an inlet passage and an outlet passage for flow of fluid to be cooled that can be fluidically connected to corresponding passages of a header of an adjacent cooling modular unit, and/or comprising:

a supply conduit for pressurized fluid fluidically connected to said inlet conduit, said supply conduit comprising a connecting portion fluidically connected to a corresponding supply conduit of an adjacent modular cooling unit.

3. The cooling unit according to claim 2, wherein said supply conduit for pressurized fluid is fluidically connected to the inlet conduits of the flow amplifiers of all the blower devices of said modular cooling unit.

4. An industrial fluid cooling system comprising a plurality of cooling units according to claim 1.

5. A cooling unit, comprising:

a plurality of the blower devices, each of the blower devices comprising:

a Coanda effect fluid flow amplifier having a suction opening to suck ambient fluid, an outlet opening to provide an amplified flow of fluid, an inner passage along an amplifier central axis passing through said suction opening and said outlet opening, an inlet conduit to input pressurized fluid into said inner passage for drawing said ambient fluid from said suction opening to said outlet opening by Coanda effect along said inner passage forming said amplified flow along said amplifier central axis;

a diffuser device arranged downstream of said fluid flow amplifier, comprising diffuser side walls which define a diffuser inner side surface extended around a diffuser central axis arranged along said amplifier central axis and is terminated with a first flow inlet open end facing said outlet opening, and a second flow outlet open end opposite said first flow inlet open end, adapted to deliver a further amplified fluid flow;

wherein said blower device comprises at least one side opening arranged upstream of said second flow outlet open end, to allow a further amount of ambient fluid to be sucked into said diffuser device;

wherein the second flow outlet open end of the diffuser device lies on a lying plane transverse to the diffuser central axis;

a tube bundle comprising a plurality of tubes adapted to be traversed by a fluid to be cooled and adapted to be lapped externally by said further amplified flow, said tube bundle being arranged on the opposite side of the lying plane with respect to said diffuser device;

a frame to support said blower device and said tube bundle;

said blower devices being arranged side by side so that the diffuser central axis of each blower device is substantially parallel to the diffuser central axis of the other blower devices of the plurality of blower devices, wherein the second flow outlet open end of each diffuser device lies on a same lying plane and said tube bundle is arranged on the opposite side of the lying plane with respect to said plurality of blower devices.

6. The cooling unit according to claim 5, wherein said second flow outlet open end of each diffuser device has a polygonal closed shape with straight sides, wherein said straight sides of each diffuser are arranged parallel to corresponding straight sides of the adjoining diffuser devices and at a predetermined distance therebetween.

7. The cooling unit according to claim 6, wherein said predetermined distance is substantially equal to a product of:

$$2S \times tg(\alpha 2/2)$$

where $\alpha 2$ is an angle of aperture of the flow cone and S is the thickness of the tube bundle measured in a direction parallel to the diffuser central axis.

* * * * *